US010971069B2

(12) United States Patent
Wang et al.

(10) Patent No.: US 10,971,069 B2
(45) Date of Patent: Apr. 6, 2021

(54) PIXEL DRIVING CIRCUIT, DRIVING METHOD THEREOF AND DISPLAY DEVICE

(71) Applicant: BOE TECHNOLOGY GROUP CO., LTD., Beijing (CN)

(72) Inventors: Tieshi Wang, Beijing (CN); Kuanjun Peng, Beijing (CN); Wei Qin, Beijing (CN); Chengchung Yang, Beijing (CN); Xueling Gao, Beijing (CN); Xiaolong Li, Beijing (CN); Zhiqiang Xu, Beijing (CN); Yan Wei, Beijing (CN); Shengnan Li, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/616,234

(22) PCT Filed: Apr. 18, 2019

(86) PCT No.: PCT/CN2019/083223

§ 371 (c)(1),
(2) Date: Nov. 22, 2019

(87) PCT Pub. No.: WO2019/206018

PCT Pub. Date: Oct. 31, 2019

(65) Prior Publication Data

US 2020/0090591 A1 Mar. 19, 2020

(30) Foreign Application Priority Data

Apr. 28, 2018 (CN) ..... 201810401414.3

(51) Int. Cl.
*G09G 3/3258* (2016.01)

(52) U.S. Cl.
CPC ... *G09G 3/3258* (2013.01); *G09G 2300/0426* (2013.01); *G09G 2320/0257* (2013.01)

(58) Field of Classification Search
CPC ..... G09G 3/3258; G09G 2300/0426; G09G 2320/0257; G09G 2320/0261;
(Continued)

(56) References Cited

U.S. PATENT DOCUMENTS 10,008,153 B2 * 6/2018 Hu ..... G09G 3/3258
2005/0237001 A1 10/2005 Hayafuji
(Continued)

FOREIGN PATENT DOCUMENTS

CN 1685390 A 10/2005
CN 1691111 A 11/2005
(Continued)

OTHER PUBLICATIONS

1st Chinese Office Action, English Translation.
(Continued)

*Primary Examiner* — Andrew Sasinowski
(74) *Attorney, Agent, or Firm* — Brooks Kushman P.C.

(57) ABSTRACT

A pixel driving circuit, a driving method and a display device are provided. The pixel driving circuit includes a driving unit, a capacitor unit, a data write-in unit connected to a corresponding gate line, a corresponding data line and the driving unit, a power source control unit connected to a first light-emitting control end, a power source signal input end and the driving unit, and a first light-emitting control unit connected to a second light-emitting control end, the power source signal input end and the driving unit and configured to, within a predetermined time period of a light-emitting stage, control the power source signal input end to be electrically connected to the driving unit under the control of the second light-emitting control end, stop the operation of the driving unit, and enable the light-emitting unit not to emit light.

20 Claims, 8 Drawing Sheets

(58) Field of Classification Search
CPC ... G09G 2300/0861; G09G 2300/0819; G09G 3/3233; G09G 2320/043; G09G 3/3225
See application file for complete search history.

(56) References Cited

U.S. PATENT DOCUMENTS

| | | | | |
|---|---|---|---|---|
| 2006/0038751 | A1 | 2/2006 | Johnson et al. | |
| 2006/0208974 | A1 | 9/2006 | Hara | |
| 2008/0068312 | A1 | 3/2008 | Kim | |
| 2011/0025586 | A1 | 2/2011 | Lee | |
| 2011/0090208 | A1* | 4/2011 | Long | G09G 3/3233 345/211 |
| 2016/0307502 | A1 | 10/2016 | Nie | |
| 2017/0124958 | A1 | 5/2017 | Pyo et al. | |
| 2017/0221420 | A1 | 8/2017 | Zhu | |
| 2017/0263188 | A1* | 9/2017 | Na | G09G 3/3258 |
| 2018/0068611 | A1* | 3/2018 | Chaji | G09G 3/3233 |
| 2018/0218677 | A1* | 8/2018 | Qing | G09G 3/3233 |
| 2019/0073955 | A1* | 3/2019 | Zou | G09G 3/3233 |
| 2019/0096322 | A1* | 3/2019 | Gao | G09G 3/3233 |
| 2020/0090591 | A1 | 3/2020 | Wang et al. | |
| 2020/0312244 | A1* | 10/2020 | Yang | G09G 3/3275 |

FOREIGN PATENT DOCUMENTS

| | | | |
|---|---|---|---|
| CN | 1835057 | A | 9/2006 |
| CN | 101989404 | A | 3/2011 |
| CN | 104021762 | A | 9/2014 |
| CN | 104658483 | A | 5/2015 |
| CN | 106652905 | A | 5/2017 |
| CN | 106652912 | A | 5/2017 |
| CN | 108288456 | A | 7/2018 |
| WO | 2001020591 | A1 | 3/2001 |

OTHER PUBLICATIONS

2nd Chinese Office Action, English Translation.
International Search Report and Written Opinion, English Translation.
CN1685390A, English Abstract and U.S. Equivalent U.S. Pub. No. 2006/0038751.
CN1691111A, English Abstract and U.S. Equivalent U.S. Pub. No. 2005/0237001.
CN1835057A, English Abstract and U.S. Equivalent U.S. Pub. No. 2006/0208974.
CN101989404A, English Abstract and U.S. Equivalent U.S. Pub. No. 2011/0025586.
CN104021762A, English Abstract and Machine Translation.
CN104658483A, English Abstract and U.S. Equivalent U.S. Pub. No. 2016/0307502.
CN106652905A, English Abstract and U.S. Equivalent U.S. Pub. No. 2017/0124958.
CN106652912A, English Abstract and U.S. Equivalent U.S. Pub. No. 2017/0221420.
CN108288456A, English Abstract and U.S. Equivalent U.S. Pub. No. 2020/0090591.
First Office Action for Chinese Application No. 201810401414.3, dated Jun. 4, 2019, 5 Pages.
International Search Report and Written Opinion for Application No. PCT/CN2019/083223, dated Jul. 24, 2019, 11 Pages.
Second Office Action for Chinese Application No. 201810401414.3, dated Dec. 4, 2019, 8 Pages.

* cited by examiner

PIXEL DRIVING CIRCUIT, DRIVING METHOD THEREOF AND DISPLAY DEVICE

CROSS-REFERENCE TO RELATED APPLICATIONS

This application is the U.S. national phase of PCT Application No. PCT/CN2019/083223 filed on Apr. 18, 2019, which claims priority to Chinese Patent Application No. 201810401414.3 filed on Apr. 28, 2018, which are incorporated herein by, reference in their entireties.

TECHNICAL FIELD

The present disclosure relates to the field of display technology, in particular to a pixel driving circuit, a driving method thereof and a display device.

BACKGROUND

Currently, when an image displayed by a commonly-used Active-Matrix Organic Light-Emitting Diode (AMOLED) display device, as a maintenance-type display device, includes an object that moves rapidly, due to an effect of persistence of vision for a human eye, a position of the object perceived by the viewer's brain is different from a position of the object displayed on the AMOLED display device. At this time, a dynamic ghost is generated on the AMOLED display device, and thereby the user experience is adversely affected.

SUMMARY

In one aspect, the present disclosure provides in some embodiments a pixel driving circuit for driving a light-emitting unit, including: a driving unit connected to the light-emitting unit; a capacitor unit, one end of which is connected to the driving unit, and a second end of which is connected to a power source signal input end; a data write-in unit connected to a corresponding gate line, a corresponding data line and the driving unit; a power source control unit connected to a first light-emitting control end, the power source signal input end and the driving unit; and a first light-emitting control unit connected to a second light-emitting control end, the power source signal input end and the driving unit, and configured to, within a predetermined time period of a light-emitting stage, control the power source signal input end to be electrically connected to the driving unit under the control of the second light-emitting control end, stop the operation of the driving unit, and enable the light-emitting unit not to emit light.

In a possible embodiment of the present disclosure, the driving unit includes a driving transistor, a first electrode of which is connected to the light-emitting unit. The first end of the capacitor unit and the data write-in unit are connected to a gate electrode of the driving transistor. The power source control unit is connected to a second electrode of the driving transistor. The first light-emitting control unit is connected to the gate electrode of the driving transistor, and further configured to, within the predetermined time period of the light-emitting stage, control the power source signal input end to be electrically connected to the gate electrode of the driving transistor under the control of the second light-emitting control end.

In a possible embodiment of the present disclosure, the driving unit includes a driving transistor, a first electrode of which is connected to the light-emitting unit. The first end of the capacitor unit is connected to a gate electrode of the driving unit. The data write-in unit and the power source control unit are connected to a second electrode of the driving transistor. The first light-emitting control unit is connected to the gate electrode of the driving transistor, and further configured to, within the predetermined time period of the light-emitting stage, control the power source signal input end to be electrically connected to the gate electrode of the driving transistor under the control of the second light-emitting control end. The pixel driving circuit further includes: a first resetting unit connected to a resetting control end, the gate electrode of the driving transistor and a reference signal input end, and configured to control the gate electrode of the driving transistor to be electrically connected to, or electrically disconnected from, the reference signal input end under the control of the resetting control end; and a compensation unit connected to the corresponding gate line, the gate electrode of the driving transistor and the first electrode of the driving transistor, and configured to control the gate electrode of the driving transistor to be electrically connected to, or electrically disconnected from, the first electrode of the driving transistor under the control of the corresponding gate line.

In a possible embodiment of the present disclosure, the pixel driving circuit further includes: a second resetting unit connected to the corresponding gate line, the light-emitting unit and the reference signal input end, and configured to control the light-emitting unit to be electrically connected to, or electrically disconnected from, the reference signal input end under the control of the corresponding gate line; and a second light-emitting control unit, the driving transistor being connected to the light-emitting unit via the first electrode of the second light-emitting control unit, the second light-emitting control unit being connected to the first light-emitting control end, the first electrode of the driving transistor and the light-emitting unit, and configured to control the first electrode of the driving transistor to be electrically connected to, or electrically disconnected from, the light-emitting unit under the control of the first light-emitting control end.

In a possible embodiment of the present disclosure, the predetermined time period is a time period between a predetermined time point and an ending time point. The ending time point is a time point where the light-emitting stage is ended. The predetermined time point is any time point between T/16+D and T/4+D, where D represents a start time point of the light-emitting stage, and T represents a frame of time for display.

In a possible embodiment of the present disclosure, the data write-in unit includes a first switching transistor, a gate electrode of which is connected to the corresponding gate line, a first electrode of which is connected to the gate electrode of the driving transistor, and a second electrode of which is connected to the corresponding data line. The power source control unit includes a second switching transistor, a gate electrode of which is connected to the first light-emitting control end, a first electrode of which is connected to the second electrode of the driving transistor, and a second electrode of which is connected to the power source signal input end. The first light-emitting control unit includes a third switching transistor, a gate electrode of which is connected to the second light-emitting control end, a first electrode of which is connected to the power source signal input end, and a second electrode of which is connected to the gate electrode of the driving transistor.

In a possible embodiment of the present disclosure, the power source control unit includes a second switching transistor, a gate electrode of which is connected to the first light-emitting control end, a first electrode of which is connected to the second electrode of the driving transistor, and a second electrode of which is connected to the power source signal input end. The first light-emitting control unit includes a third switching transistor, a gate electrode of which is connected to the second light-emitting control end, a first electrode of which is connected to the power source signal input end, and a second electrode of which is connected to the gate electrode of the driving transistor. The first resetting unit includes a fourth switching transistor, a gate electrode of which is connected to the resetting control end, a first electrode of which is connected to the gate electrode of the driving transistor, and a second electrode of which is connected to the reference signal input end. The second resetting unit includes a fifth switching transistor, a gate electrode of which is connected to the corresponding gate line, a first electrode of which is connected to the light-emitting unit, and a second electrode of which is connected to the reference signal input end. The compensation unit includes a sixth switching transistor, a gate electrode of which is connected to the corresponding gate line, a first electrode of which is connected to the gate electrode of the driving transistor, and a second electrode of which is connected to the first electrode of the driving transistor. The second light-emitting control unit includes a seventh switching transistor, a gate electrode of which is connected to the first light-emitting control end, a first electrode of which is connected to the light-emitting unit, and a second electrode of which is connected to the first electrode of the driving transistor. The data write-in unit includes an eighth switching transistor, a gate electrode of which is connected to the corresponding gate line, a first electrode of which is connected to the second electrode of the driving transistor, and a second electrode of which is connected to the corresponding data line.

In another aspect, the present disclosure provides in some embodiments a method of driving the above-mentioned pixel driving circuit, including, within a predetermined time period of a light-emitting stage, controlling, by a first light-emitting control unit, a power source signal input end to be electrically connected to a driving unit under the control of a second light-emitting control end, stop the operation of the driving unit, and enable a light-emitting unit not to emit light.

In yet another aspect, the present disclosure provides in some embodiments a display device including N above-mentioned pixel driving circuits, where N is a positive integer.

In a possible embodiment of the present disclosure, the display device further includes: N pixel units arranged in a matrix form and in X rows, the pixel units corresponding to the pixel driving circuits respectively; X gate lines corresponding to the X rows of pixel units respectively; and X light-emitting control lines corresponding to the X rows of pixel units respectively, a first light-emitting control end being connected to a corresponding light-emitting control line. A second light-emitting control end is connected to an $M^{th}$ gate line randomly selected from an $(X/16+C)^{th}$ gate line to an $(X/4+C)^{th}$ gate line, or connected to an $M^{th}$ light-emitting control line randomly selected from an $(X/16+C)^{th}$ light-emitting control line to an $(X/4+C)^{th}$ light-emitting control line, where C has a value acquired by subtracting 1 from the number of rows corresponding to the second light-emitting control end. When M is greater than X, the second light-emitting control end is connected to an $(M-X)^{th}$ gate line or an $(M-X)^{th}$ light-emitting control line.

BRIEF DESCRIPTION OF THE DRAWINGS

The following drawings are provided to facilitate the understanding of the present disclosure, and constitute a portion of the description. These drawings and the following embodiments are for illustrative purposes only, but shall not be construed as limiting the present disclosure. In these drawings.

REFERENCE SIGN LIST

Figure 1:
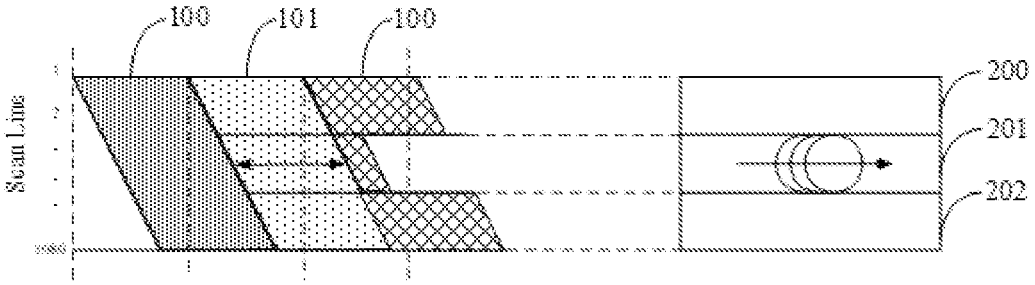
FIG. 1 is a schematic view showing a situation where a dynamic ghost is generated in the related art.

1 driving unit
2 capacitor unit
3 data write-in unit
4 power source control unit
5 first light-emitting control unit
6 first resetting unit
7 compensation unit
8 second resetting unit
9 second light-emitting control unit
10 light-emitting unit
100 static region
101 dynamic region
200 first region
201 second region
202 third region
300 pixel unit
DTFT driving transistor
Gate gate line
Data data line
EM1 first light-emitting control end
ELVDD power source signal input end
EM2 second light-emitting control end
Reset resetting control end
Vref reference signal input end
M1 first switching transistor
M2 second switching transistor
M3 third switching transistor
M4 fourth switching transistor M5 fifth switching transistor
M6 sixth switching transistor
M7 seventh switching transistor
M8 eight switching transistor
C1 first capacitor
ELVSS negative terminal of power source
T0 resetting stage
T1 data write-in stage
T2 actual light-emitting stage
T3 predetermined time period

DETAILED DESCRIPTION

The present disclosure will be described hereinafter in conjunction with the drawings and embodiments.

In the related art, when an image displayed by a display device includes an object that moves rapidly, due to an effect of persistence of vision for a human eye, a position of the object perceived by the viewer's brain is different from a position of the object displayed on the display device. At this time, a dynamic ghost is generated on the display device, and thereby the user experience is adversely affected. To be specific, as shown in FIG. 1, a static region 100 corresponds to a first region 200 and a third region 202, i.e., a static image is displayed at the first region 200 and the third region 202, and a dynamic region 101 corresponds to a second region 201, i.e., a dynamic image is displayed at the second region 201 (e.g., a spherical object moves rapidly in a direction indicated by an arrow). It is found that, a light-emitting time period corresponding to each region is between a time point where a light-emitting stage begins and a time point where a frame is ended, so when the object that moves rapidly is displayed at the second region, such a phenomenon as dynamic ghost may occur due to the effect of persistence of vision for the human eye.

Figure 2:
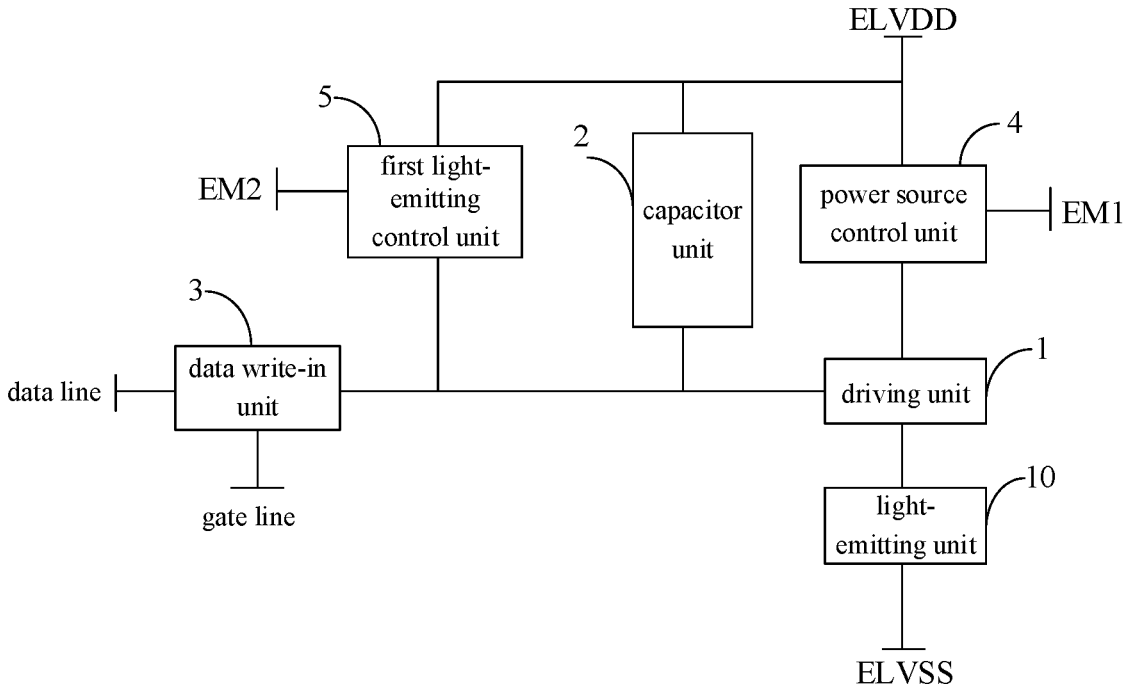
FIG. 2 is a schematic view showing a pixel driving circuit according to one embodiment of the present disclosure.

As shown in FIG. 2, the present disclosure provides in some embodiments a pixel driving circuit for driving a light-emitting unit 10. The pixel driving circuit includes a driving unit 1, a capacitor unit 2, a data write-in unit 3, a power source control unit 4 and a first light-emitting control unit 5. The driving unit 1 is connected to the light-emitting unit 10. A first end of the capacitor unit 2 is connected to the driving unit 1, and a second end of the capacitor unit 2 is connected to a power source signal input end ELVDD. The data write-in unit 3 is connected to a corresponding gate line Gate, a corresponding data line Data and the driving unit 1. The power source control unit 4 is connected to a first light-emitting control end EM1, the power source signal input end ELVDD and the driving unit 1. The first light-emitting control unit 5 is connected to a second light-emitting control end EM2, the power source signal input end ELVDD and the driving unit 1, and configured to, within a predetermined time period of a light-emitting stage, control the power source signal input end ELVDD to be electrically connected to the driving unit 1 under the control of the second light-emitting control end EM2, so as to disable the driving unit 1, thereby to enable the light-emitting unit 10 not to emit light. It should be appreciated that, the light-emitting unit 10 may be an OLED, an anode of which is connected to the driving unit 1, and a cathode of which is connected to a power source negative terminal ELVSS.

Figure 6:
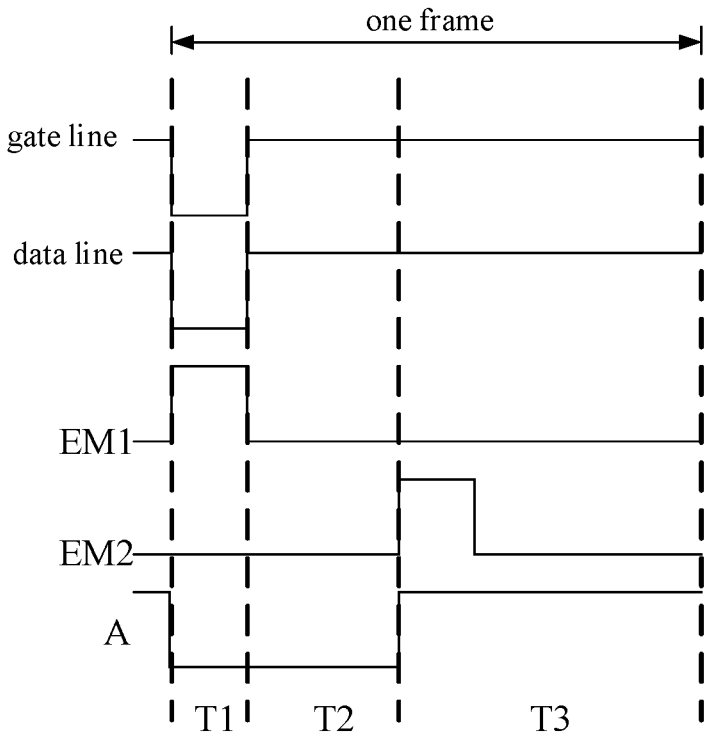
FIG. 6 is a time sequence diagram of the pixel driving circuit according to one embodiment of the present disclosure.

As shown in FIG. 6, a procedure of driving the light-emitting unit 10 by the pixel driving circuit will be described as follows.

At a data write-in stage T1, a data voltage Vdata may be applied to the corresponding data line Data, and a gate driving signal may be applied to the corresponding gate line Gate. The data write-in unit 3 may be in an operating state under the control of the gate driving signal, so as to enable the corresponding data line Data to be electrically connected to the driving unit 1, thereby to write the data voltage Vdata into the driving unit 1 and store the data voltage Vdata in the capacitor unit 2.

Within an actual light-emitting time period T2 of the light-emitting stage, the power source control unit 4 may be in an operating state under the control of the first light-emitting control end EM1, so as to enable the power source signal input end ELVDD to be electrically connected to the driving unit 1, thereby to transmit a power source signal from the power source signal input end ELVDD to the driving unit 1. At this time, the driving unit 1 may be in an operating state under the control of the data voltage and the power source signal, so as to drive the light-emitting unit 10 to emit light.

Within the predetermined time period T3 of the light-emitting stage, the first light-emitting control unit 5 may control the power source signal input end ELVDD to be electrically connected to the driving unit 1 under the control of the second light-emitting control end EM2, so as to disable the driving unit 1, thereby to enable the light-emitting unit 10 not to emit light.

On the basis of the structure of the pixel driving circuit and the procedure of driving the light-emitting unit 10 to emit light, the light-emitting unit 10 may be controlled to emit light after the light-emitting stage begins, and controlled not to emit light within the predetermined time period T3 of the light-emitting stage. As a result, it is able to reduce a light-emitting duty ratio of the light-emitting unit 10 and reduce a retention time of each image, thereby to prevent the occurrence of dynamic ghosts.

Figure 3:
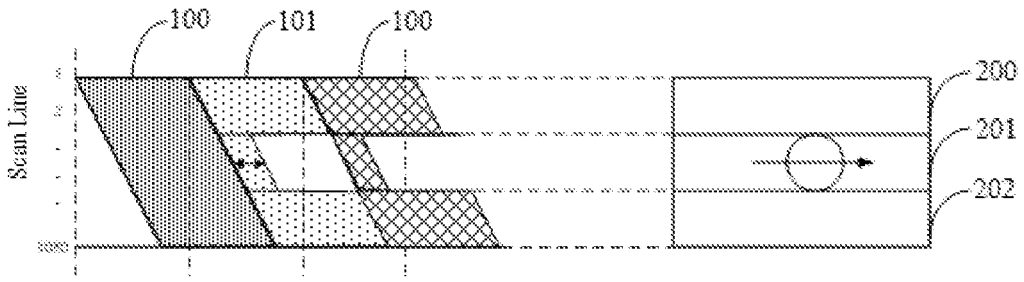
FIG. 3 is a schematic view showing a situation where no dynamic ghost is generated according to one embodiment of the present disclosure.

A double-sided arrow in the dynamic region 101 in each of FIGS. 1 and 3 shows a size of the light-emitting duty ratio of the light-emitting unit. As shown in FIG. 3, the light-emitting duty ratio of the light-emitting unit 10 is reduced, so it is able to prevent the occurrence of ghosts for an image displayed at the second region 201.

Figure 5:
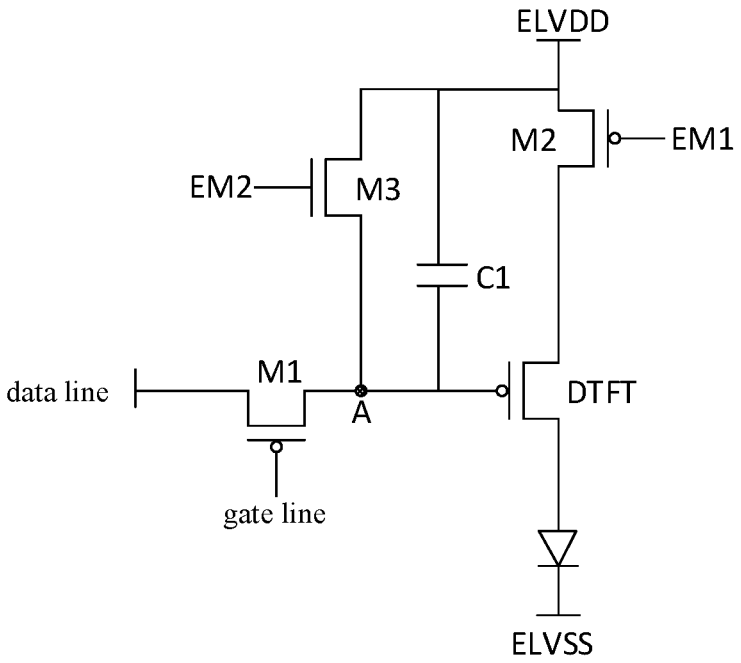
FIG. 5 is a schematic view showing a specific pixel driving circuit according to one embodiment of the present disclosure.

In a possible embodiment of the present disclosure, as shown in FIG. 5, the driving unit 1 may be of various structures, e.g., the driving unit 1 may include a driving thin film transistor (DTFT).

When the driving unit 1 includes the driving transistor DTFT, there may exist various connection modes for the pixel driving circuit. Some of the connection modes will be given, and corresponding operation procedures will be described hereinafter.

In a first connection mode, as shown in FIGS. 2 and 5, a first electrode of the driving transistor DTFT may be connected to the light-emitting unit 10. The first end of the capacitor unit 2 and the data write-in unit 3 may be connected to a gate electrode of the driving transistor DTFT. The power source control unit 4 may be connected to a second electrode of the driving transistor DTFT. The first light-emitting control unit 5 may be connected to the gate electrode of the driving transistor DTFT, and configured to, within the predetermined time period T3 of the light-emitting stage, control the power source signal input end ELVDD to be electrically connected to the gate electrode of the driving transistor DTFT under the control of the second light-emitting control end EM2.

To be specific, as shown in FIG. 6, the operation procedure of the pixel driving circuit in the first connection mode will be described as follows.

Figure 7A:
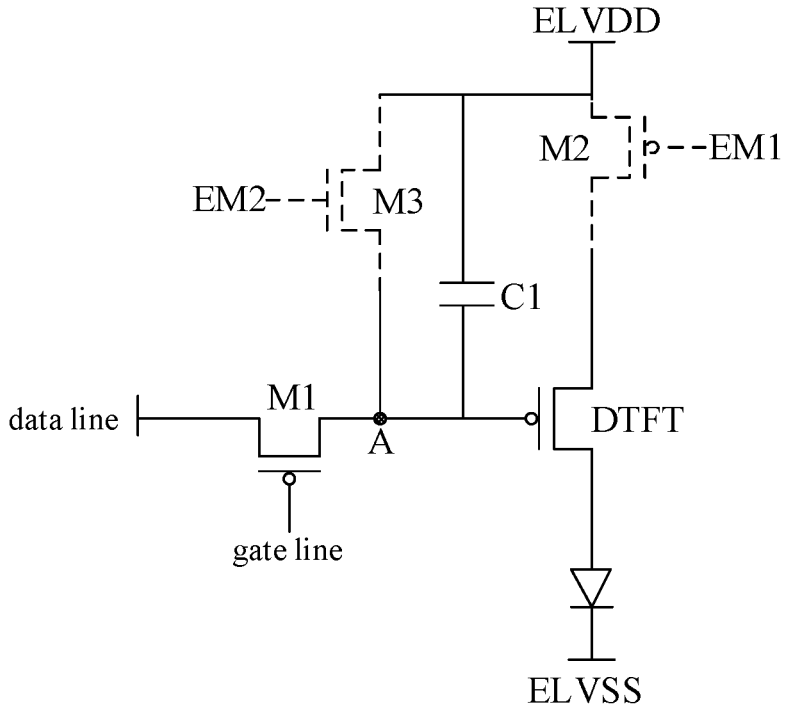
FIGS. 7*a*-7*c* are circuit diagrams showing the operations of the pixel driving circuit according to one embodiment of the present disclosure.

At the data write-in stage T1, as shown in FIG. 7*a*, a data voltage may be applied to the corresponding data line Data, and a gate driving signal may be applied to the corresponding gate line Gate. The data write-in unit 3 may be in an operating state under the control of the gate driving signal, so as to enable the corresponding data line Data to be electrically connected to the gate electrode of the driving transistor DTFT, thereby to write the data voltage into the gate electrode of the driving transistor DTFT and store the data voltage in the capacitor unit 2.

Figure 7B:
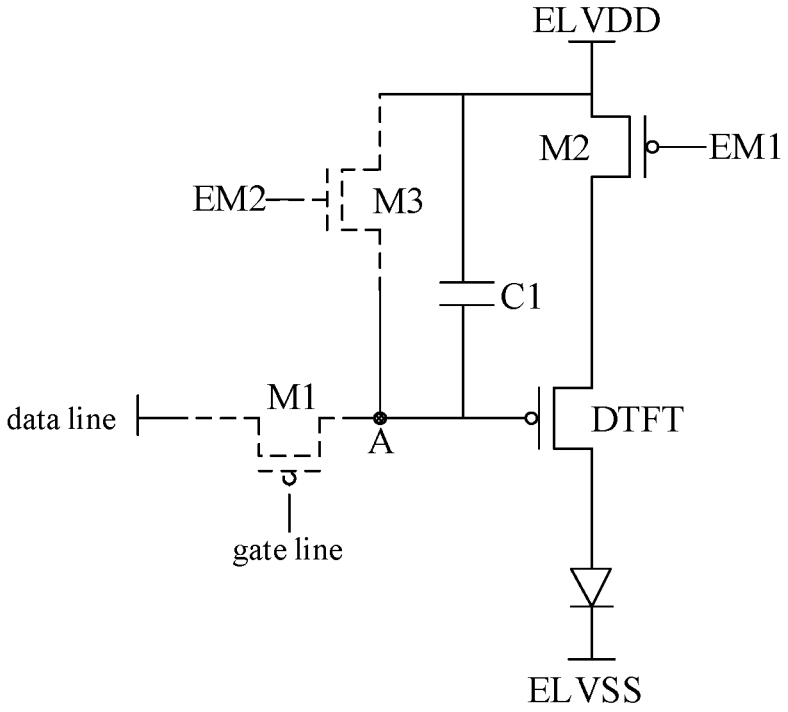

Within the actual light-emitting time period T2 of the light-emitting stage, as shown in FIG. 7*b*, the power source control unit 4 may be in an operating state under the control of the first light-emitting control end EM1, so as to enable the power source signal input end ELVDD to be electrically connected to the second electrode of the driving transistor DTFT, thereby to transmit a power source signal from the power source signal input end ELVDD to the second electrode of the driving transistor DTFT. At this time, the driving transistor DTFT may be turned on under the control of the data voltage and the power source signal, so as to drive the light-emitting unit 10 to emit light.

Figure 7C:
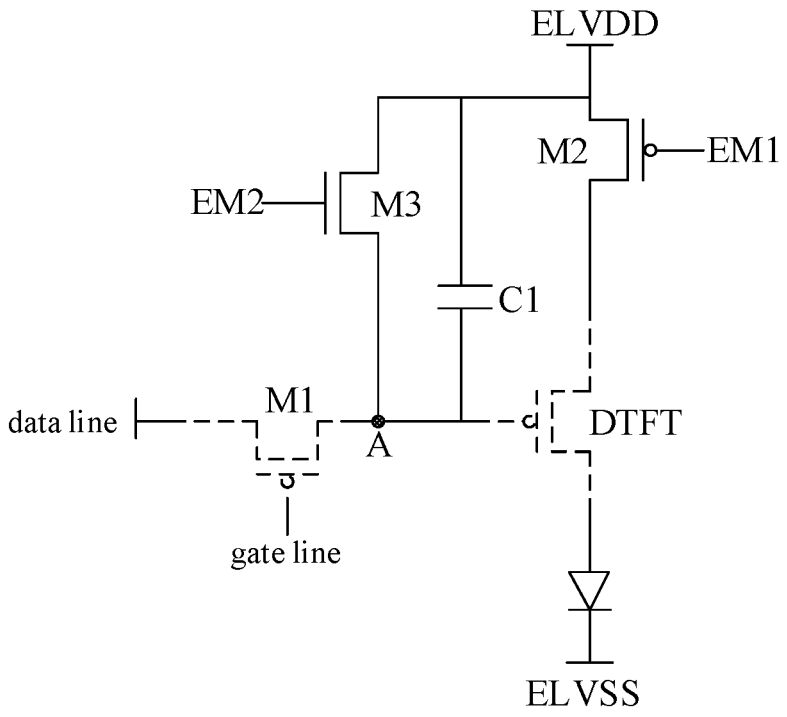

Within the predetermined time period T3 of the light-emitting stage, as shown in FIG. 7*c*, the first light-emitting control unit 5 may control the power source signal input end ELVDD to be electrically connected to the gate electrode of the driving transistor DTFT under the control of the second light-emitting control end EM2, so as to turn off the driving transistor DTFT, thereby to enable the light-emitting unit 10 not to emit light.

In a possible embodiment of the present disclosure, in the first connection mode, the data write-in unit 3, the power source control unit 4 and the first light-emitting control unit 5 may each be of various structures. As shown in FIG. 5, the data write-in unit 3 may include a first switching transistor M1, a gate electrode of which is connected to the corresponding gate line Gate, a first electrode of which is connected to the gate electrode of the driving transistor DTFT, and a second electrode of which is connected to the corresponding data line Data. The power source control unit 4 may include a second switching transistor M2, a gate electrode of which is connected to the first light-emitting control end EM1, a first electrode of which is connected to the second electrode of the driving transistor DTFT, and a second electrode of which is connected to the power source signal input end ELVDD. The first light-emitting control unit 5 may include a third switching transistor M3, a gate electrode of which is connected to the second light-emitting control end EM2, a first electrode of which is connected to the power source signal input end ELVDD, and a second electrode of which is connected to the gate electrode of the driving transistor DTFT.

It should be appreciated that, when the data write-in unit 3 is in the operating state, the first switching transistor M1 may be turned on, and when the data write-in unit 3 is not in the operating state, the first switching transistor M1 may be turned off. When the power source control unit 4 is in the operating state, the first switching transistor M2 may be turned on, and when the power source control unit 4 is not in the operating state, the second switching transistor M2 may be turned off. When the first light-emitting control unit 5 is in the operating state, the third switching transistor M3 may be turned on, and when the first light-emitting control unit 5 is not in the operating state, the third transistor M3 may be turned off.

Figure 4:
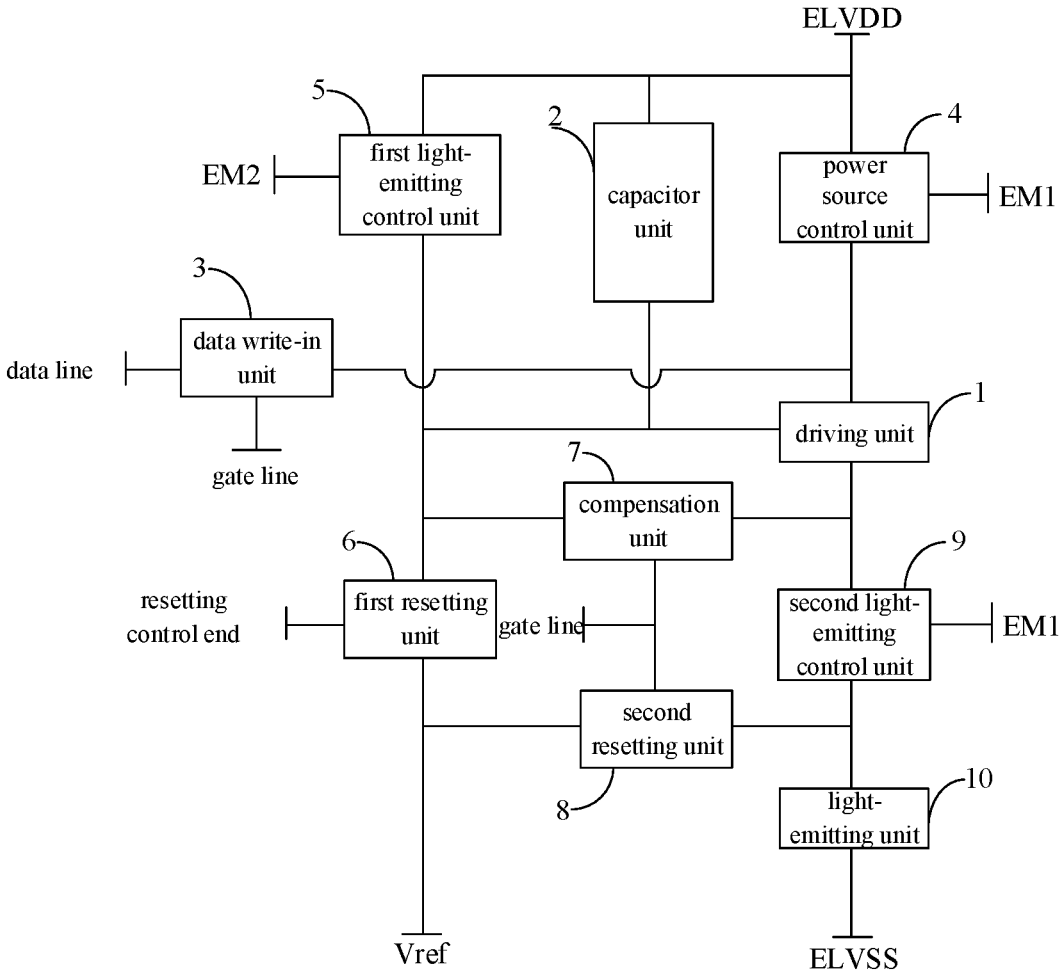
FIG. 4 is another schematic view showing the pixel driving circuit according to one embodiment of the present disclosure.
Figure 8:
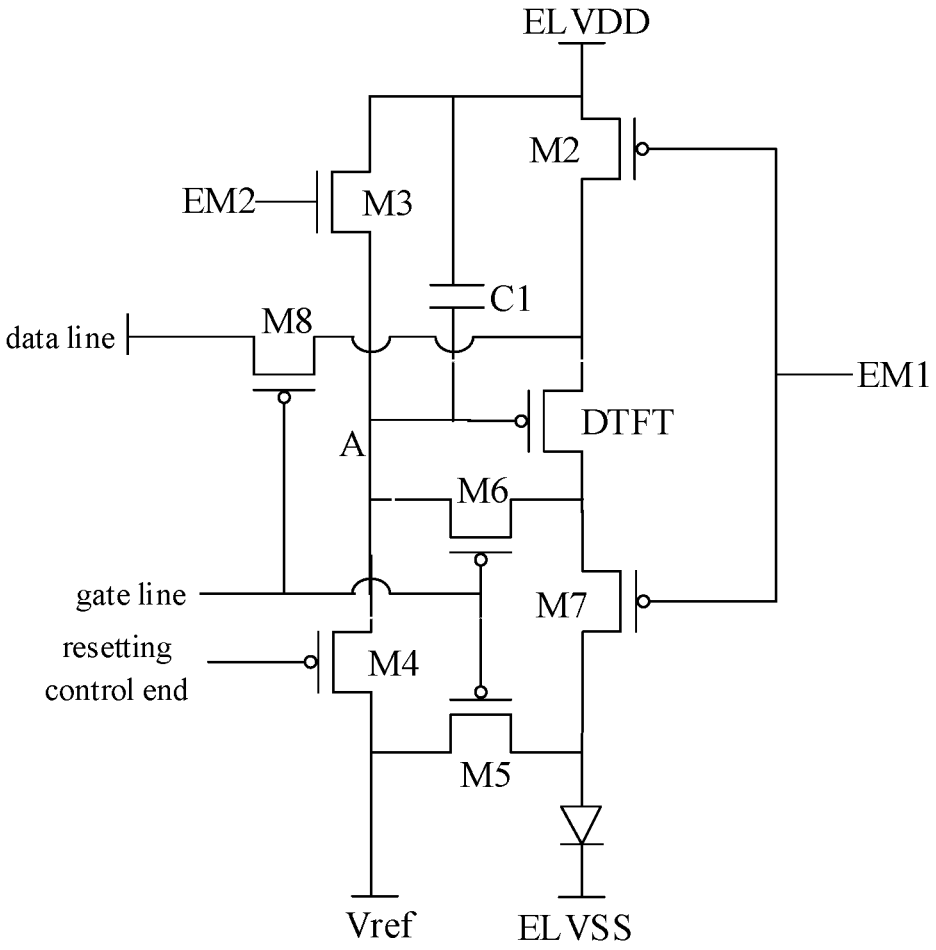
FIG. 8 is another schematic view showing a specific pixel driving circuit according to one embodiment of the present disclosure.

In a second connection mode, as shown in FIGS. 4 and 8, the first electrode of the driving transistor DTFT may be connected to the light-emitting unit 10, the first end of the capacitor unit 2 may be connected to the gate electrode of the driving transistor DTFT, and the data write-in unit 3 and the power source control unit 4 may be connected to the second electrode of the driving transistor DTFT. The first light-emitting control unit 5 may be connected to the gate electrode of the driving transistor DTFT, and configured to, within the predetermined time period T3 of the light-emitting stage, control the power source signal input end ELVDD to be electrically connected to the gate electrode of the driving transistor DTFT under the control of the second light-emitting control end EM2.

In the second connection mode, the pixel driving circuit may further include a first resetting unit 6 and a compensation unit 7. The first resetting unit 6 may be connected to a resetting control end Reset, the gate electrode of the driving transistor DTFT and a reference signal input end Vref, and configured to control the gate electrode of the driving transistor DTFT to be electrically connected to, or electrically disconnected from, the reference signal input end Vref under the control of the resetting control end Reset. The compensation unit 7 may be connected to the corresponding gate line Gate, and the gate electrode and the first electrode of the driving transistor DTFT, and configured to control the gate electrode of the driving transistor DTFT to be electrically connected to, or electrically disconnected from, the first electrode of the driving transistor DTFT under the control of the corresponding gate line Gate.

Figure 9:
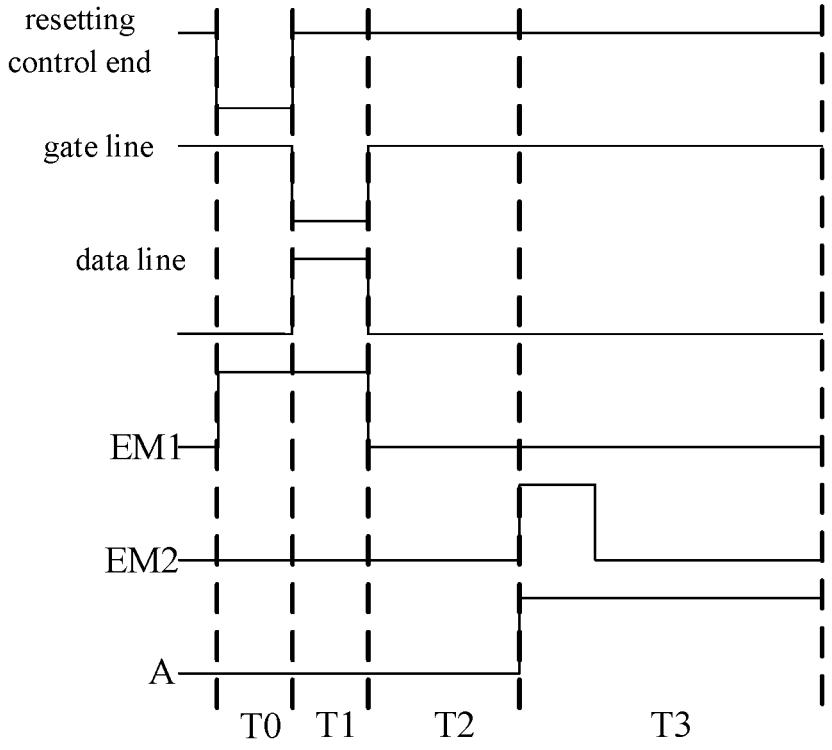
FIG. 9 is another time sequence diagram of the pixel driving circuit according to one embodiment of the present disclosure.

To be specific, as shown in FIG. 9, an operation procedure of the pixel driving circuit in the second connection mode will be described as follows.

At a resetting stage T0, a reference voltage may be applied to the reference signal input end Vref. The first resetting unit 6 may control the gate electrode of the driving transistor DTFT to be electrically connected to the reference signal input end Vref under the control of the resetting control end Reset, so as to enable a potential at the gate electrode of the driving transistor DTFT to be the reference voltage. The power source control unit 4 may not be in the operating state under the control of the first light-emitting control end EM1, so as to control the power source signal input end ELVDD to be electrically disconnected from the second electrode of the driving transistor DTFT.

At the data write-in stage T1, the driving transistor DTFT may be turned on under the control of the reference voltage. The first resetting unit 6 may control the gate electrode of the driving transistor DTFT to be electrically disconnected from the reference signal input end Vref under the control of the resetting control end Reset. The power source control unit 4 may not be in the operating state under the control of the first light-emitting control end EM1, so it may continuously control the power source signal input end ELVDD to be electrically disconnected from the second electrode of the driving transistor DTFT. A data voltage may be applied to the corresponding data line Data, and a gate driving signal may be applied to the corresponding gate line Gate. The data write-in unit 3 may be in the operating state under the control of the gate driving signal, so as to enable the corresponding data line Data to be electrically connected to the second electrode of the driving transistor DTFT. In addition, the compensation unit 7 may be in an operating state under the control of the gate driving signal, so as to control the gate electrode of the driving transistor DTFT to be electrically connected to, or electrically disconnected from, the first electrode of the driving transistor DTFT, thereby to write the data voltage Vdata into the gate electrode of the driving transistor DTFT through the data write-in unit 3, the driving transistor DTFT and the compensation unit 7 until a voltage applied to the gate electrode of the driving transistor DTFT is equal to Vdata+Vth (where Vth represents a threshold voltage of the driving transistor DTFT), and store Vdata+Vth in the capacitor unit 2.

Within the actual light-emitting time period T2 of the light-emitting stage, the data write-in unit 3 and the compensation unit 7 may each not be in the operating state under the control of the corresponding gate line Gate. The power source control unit 4 may be in the operating state under the control of the first light-emitting control end EM1, so as to control the power source signal input end ELVDD to be electrically connected to the second electrode of the driving transistor DTFT, thereby to apply the power source signal from the power source signal input end ELVDD to the second electrode of the driving transistor DTFT. At this time, the driving transistor DTFT may be turned on under the control of the potential at the gate electrode of the driving transistor DTFT (i.e., Vdata+Vth) and the power source signal, so as to drive the light-emitting unit 10 to emit light.

Within the predetermined time period T3 of the light-emitting stage, the first light-emitting control unit 5 may control the power source signal input end ELVDD to be electrically connected to the gate electrode of the driving transistor DTFT under the control of the second light-emitting control end EM2, so as to turn off the driving transistor DTFT, thereby to enable the light-emitting unit 10 not to emit light.

In a possible embodiment of the present disclosure, as shown in FIGS. 4 and 8 again, the pixel driving circuit may further include a second resetting unit 8 and a second light-emitting control unit 9. The second resetting unit 8 may be connected to the corresponding gate line Gate, the light-emitting unit 10 and the reference signal input end Vref, and configured to control the light-emitting unit 10 to be electrically connected to, or electrically disconnected from, the reference signal input end Vref under the control of the corresponding gate line Gate. The first electrode of the driving transistor DTFT may be connected to the light-emitting unit 10 through the second light-emitting control unit 9. The second light-emitting control unit 9 may be connected to the first light-emitting control end EM1, the first electrode of the driving transistor DTFT and the light-emitting unit 10, and configured to control the first electrode of the driving transistor DTFT to be electrically connected to, or electrically disconnected from, the light-emitting unit 10 under the control of the first light-emitting control end EM1.

To be specific, when the pixel diving circuit further includes the second resetting unit 8 and the second light-emitting control unit 9, the operation procedure of the pixel driving circuit will be described as follows.

At the data write-in state T1, the second resetting unit 8 may control the light-emitting unit 10 to be electrically connected to the reference signal input end Vref under the control of the corresponding gate line Gate, so as to reset the light-emitting unit 10. At the stages other than data write-in stage, the second resetting unit 8 may control the light-emitting unit 10 to be electrically disconnected from the reference signal input end Vref under the control of the corresponding gate line Gate.

At the light-emitting stage (including T2 and T3), the second light-emitting control unit 9 may control the first electrode of the driving transistor DTFT to be electrically connected to the light-emitting unit 10 under the control of the first light-emitting control end EM1. At the resetting stage T0 and the data write-in stage T1, the second light-emitting control unit 9 may control the first electrode of the driving transistor DTFT to be electrically connected to the light-emitting unit 10 under the control of the first light-emitting control end EM1.

It should be appreciated that, the light-emitting unit 10 may be an OLED, an anode of which is connected to the second resetting unit 8.

In a possible embodiment of the present disclosure, as shown in FIG. 8, in the second connection mode, the data write-in unit 3, the power source control unit 4, the first light-emitting control unit 5, the first resetting unit 6, the second resetting unit 8, the compensation unit 7 and the second light-emitting control unit 9 may each be of various structures. For example, the power source control unit 4 may include a second switching transistor M2, a gate electrode of which is connected to the first light-emitting control end EM1, a first electrode of which is connected to the second electrode of the driving transistor DTFT, and a second electrode of which is connected to the power source signal input end ELVDD. The first light-emitting control unit 5 may include a third switching transistor M3, a gate electrode of which is connected to the second light-emitting control end EM2, a first electrode of which is connected to the power source signal input end ELVDD, and a second electrode of which is connected to the gate electrode of the driving transistor DTFT. The first resetting unit 6 may include a fourth switching transistor M4, a gate electrode of which is connected to the resetting control end Reset, a first electrode of which is connected to the gate electrode of the driving transistor DTFT, and a second electrode of which is connected to the reference signal input end Vref. The second resetting unit 8 may include a fifth switching transistor M5, a gate electrode of which is connected to the corresponding gate line Gate, a first electrode of which is connected to the light-emitting unit 10, and a second electrode of which is connected to the reference signal input end Vref. The compensation unit 7 may include a sixth switching transistor M6, a gate electrode of which is connected to the corresponding gate line Gate, a first electrode of which is connected to the gate electrode of the driving transistor DTFT, and a second electrode of which is connected to the first electrode of the driving transistor DTFT. The second light-emitting control unit 9 may include a seventh switching transistor M7, a gate electrode of which is connected to the first light-emitting control end EM1, a first electrode of which is connected to the light-emitting unit 10, and a second electrode of which is connected to the first electrode of the driving transistor DTFT. The data write-in unit 3 may include an eighth switching transistor M8, a gate electrode of which is connected to the corresponding gate line Gate, a first electrode of which is connected to the second electrode of the driving transistor DTFT, and a second electrode of which is connected to the corresponding data line Data. It should be appreciated that, the capacitor unit 2 may include a first capacitor C1.

In a possible embodiment of the present disclosure, the predetermined time period T3 may be a time period between a predetermined time point and an ending time point. The ending time point may be a time point where the light-emitting stage is ended. The predetermined time point may be any time point between T/16+D and T/4+D, where D represents a start time point of the light-emitting stage, and T represents a frame.

To be specific, the light-emitting stage may include the actual light-emitting time period T2 and the predetermined time period T3. Within the light-emitting time period T2, the light-emitting unit 10 may emit light, and within the predetermined time period T3, the light-emitting unit 10 may not emit light. A range of the predetermined time period T3 may be set according to the practical need, as long as it is able for the viewer to clearly view each image and it is able to prevent the occurrence of the ghosts. In a possible embodiment of the present disclosure, the predetermined time period may be any time point Y between T/16+D and T/4+D, and the ending time point may be a time point where the light-emitting stage is ended, i.e., the actual light-emitting time period T2 may be between the start time point of the light-emitting stage and the time point Y, and the predetermined time period T3 may be between the time point Y and the ending time point of the light-emitting stage.

It should be appreciated that, the pixel driving circuit has been described hereinabove merely on the basis of the above-mentioned circuit structure. In some other embodiments of the present disclosure, each unit of the pixel driving circuit may also be of any other structure, which will not be particularly defined herein. In addition, the driving transistor DTFT and the switching transistors may each be a TFT, a field effect transistor (FET) or any other element having a same characteristic. In order to differentiate two electrodes other than a gate electrode from each other, one of the two electrodes is called as first electrode and the other is called as second electrode. In actual use, the first electrode may be a drain electrode while the second electrode may be a source electrode, or the first electrode may be a source electrode while the second electrode may be a drain electrode. In addition, the driving transistor DTFT and the switching transistors may each be an N-type or a P-type transistor according to the practical need.

The present disclosure further provides in some embodiments a method of driving the above-mentioned pixel driving circuit, which includes: at the data write-in stage T1, applying a data voltage to the corresponding data line Data, and applying a gate driving signal to a corresponding gate line Gate, so as to control the data write-in unit 3 to be in an operating state under the control of the gate driving signal and control the corresponding data line Data to be electrically connected to the driving unit 1, thereby to write the data voltage into the driving unit 1 and store the data voltage in the capacitor unit 2; within the actual light-emitting time period T2 of the light-emitting stage, controlling the power source control unit 4 to be in an operating state under the control of the first light-emitting control end EM1, so as to control the power source signal input end ELVDD to be electrically connected to the driving unit 1, transmit a power source signal from the power source signal input end ELVDD to the driving unit 1, and enable the driving unit 1 to be in the operating state under the control of the data voltage and the power source signal, thereby to drive the light-emitting unit 10 to emit light; and within the predetermined time period T3 of the light-emitting stage, controlling, by the first light-emitting control unit 5, the power source signal input end ELVDD to be electrically connected to the driving unit 1 under the control of the second light-emitting control end EM2, thereby to disable the driving unit 1 and enable the light-emitting unit 10 not to emit light.

On the basis of the driving procedure of the pixel driving circuit, the light-emitting unit 10 may emit light after the light-emitting stage begins, and the light-emitting unit 10 may not emit light within the predetermined time period T3 of the light-emitting stage. As a result, it is able to reduce a light-emitting duty ratio of the light-emitting unit 10 and reduce a retention time of each image, thereby to prevent the occurrence of dynamic ghosts.

The present disclosure further provides in some embodiments a display device including N above-mentioned pixel driving circuits, where N is a positive integer.

When the pixel driving circuit drives the light-emitting unit 10 to emit light, it is able to prevent the occurrence of ghosts. Hence, when the display device includes the above-mentioned pixel driving circuit, it is also able to prevent the occurrence of dynamic ghosts when an image is displayed, thereby to improve a display effect of the display device.

Figure 10:
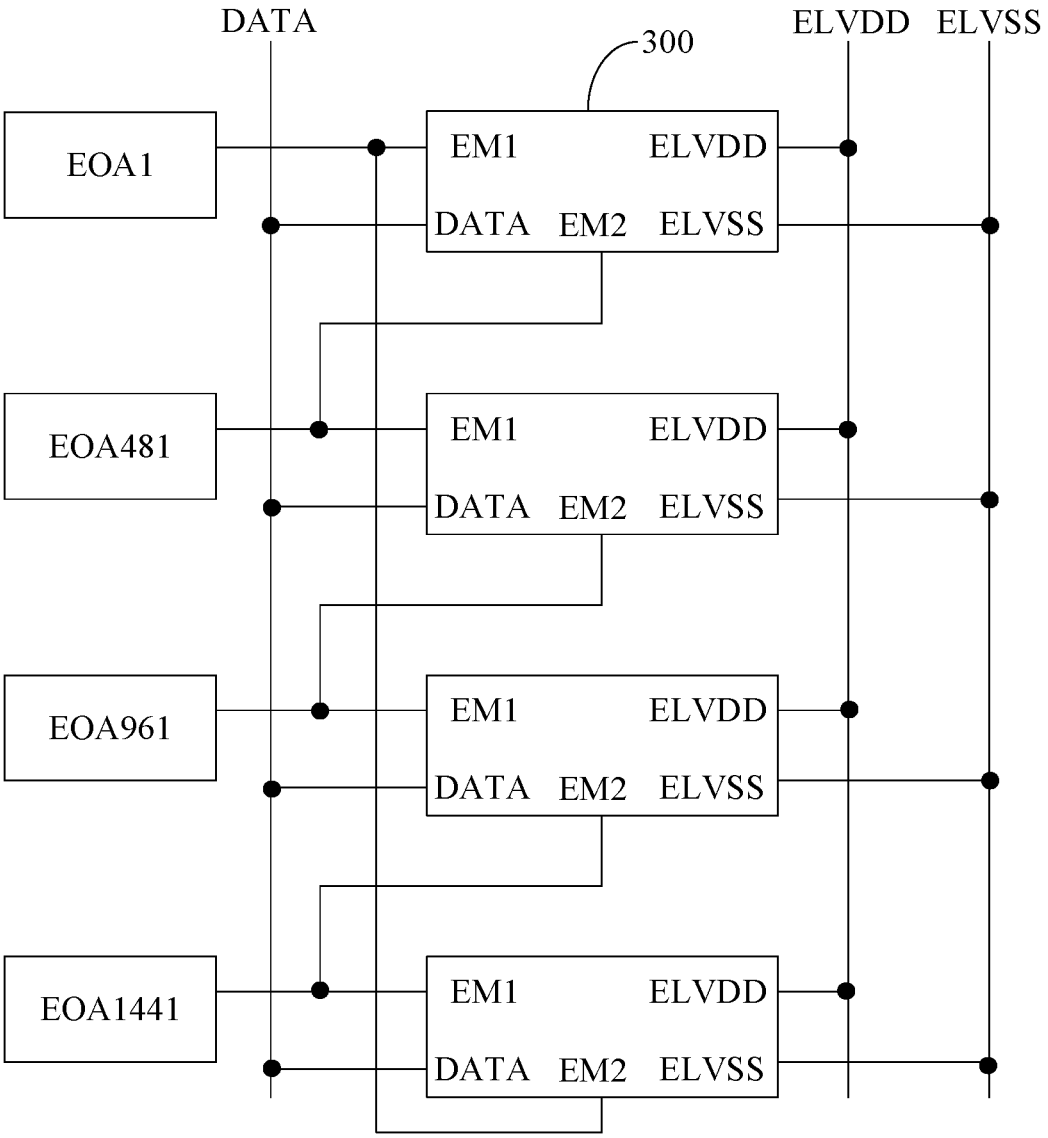
FIG. 10 is a schematic view showing a connection relationship of pixel units in a display device according to one embodiment of the present disclosure.

In a possible embodiment of the present disclosure, the display device may further include: N pixel units 300 arranged in a matrix form and in X rows (as shown in FIG. 10), the pixel units 300 corresponding to the pixel driving circuits respectively; X gate lines corresponding to the X rows of pixel units 300 respectively; and X light-emitting control lines corresponding to the X rows of pixel units 300 respectively, the first light-emitting control end EM1 being connected to a corresponding light-emitting control line. A second light-emitting control end EM2 may be connected to an $M^{th}$ gate line randomly selected from an $(X/16+C)^{th}$ gate line to an $(X/4+C)^{th}$ gate line, or connected to an $M^{th}$ light-emitting control line randomly selected from an $(X/16+C)^{th}$ light-emitting control line to an $(X/4+C)^{th}$ light-emitting control line, where C has a value acquired by subtracting 1 from the number of rows corresponding to the second light-emitting control end EM2. When M is greater than X, the second light-emitting control end EM2 may be connected to an $(M-X)^{th}$ gate line or an $(M-X)^{th}$ light-emitting control line.

To be specific, the display device may include X gate lines, and each gate line may be connected to the data write-in unit 3 of a corresponding pixel driving circuit. The display device may further include X light-emitting control lines, and each light-emitting control line may be connected to the power source control unit 4 of the corresponding pixel driving circuit, i.e., the first light-emitting control end EM1 connected to the power source control unit 4 may be connected to a corresponding light-emitting control line.

In a possible embodiment of the present disclosure, in order to prevent the introduction of any other additional signal line into the display device, the second light-emitting control end EM2 connected to the first light-emitting control unit 5 of the pixel driving circuit may be connected to the corresponding gate line or light-emitting control line of the display device according to the practical need. For example, the second light-emitting control end EM2 may be connected to the $M^{th}$ gate line randomly selected from the $(X/16+C)^{th}$ gate line to the $(X/4+C)^{th}$ gate line, or connected to an $M^{th}$ light-emitting control line randomly selected from the $(X/16+C)^{th}$ light-emitting control line to the $(X/4+C)^{th}$ light-emitting control line. In addition, when M is greater than X, the second light-emitting control end EM2 may be connected to the $(M-X)^{th}$ gate line or the $(M-X)^{th}$ light-emitting control line.

More specifically, a connection mode of the second light-emitting control end EM2 may be determined in accordance with a type of the third switching transistor M3 of the first light-emitting control unit 5. For example, when the third switching transistor is an N-type transistor, the second light-emitting control end EM2 may be connected to the corresponding light-emitting control line, so as to control an on state and an off state of the third switching transistor M3 through the corresponding light-emitting control line. When the third switching transistor is a P-type transistor, the second light-emitting control end EM2 may be connected to the corresponding gate line, so as to control the on state and the off state of the third switching transistor M3 through the corresponding gate line.

A connection relationship of the display device will be described hereinafter illustratively. As shown in FIG. 10, EOA represents a light-emitting control signal output unit, an output end of which is connected to a corresponding light-emitting control line connected to the corresponding first light-emitting control end EM1. EOA1 represents a light-emitting control signal output unit corresponding to the pixel units 300 in a first row, EOA481 represents a light-emitting control signal output unit corresponding to the pixel units 300 in a $481^{st}$ row, EOA961 represents a light-emitting control signal output unit corresponding to the pixel units 300 in a $961^{st}$ row, and EOA1441 represents a light-emitting control signal output unit corresponding to the pixel units 300 in a $1441^{st}$ row. The second light-emitting control end EM2 corresponding to the pixel units in the first row may be connected to a $481^{st}$ light-emitting control line which is connected to EOA481. The second light-emitting control end EM2 corresponding to the pixel units 300 in the $481^{st}$ row may be connected to a $961^{st}$ light-emitting control line which is connected to EOA961. The second light-emitting control end EM2 corresponding to the pixel units 300 in the $961^{st}$ row may be connected to a $1441^{st}$ light-emitting control line which is connected to EOA1441. The second light-emitting control end EM2 corresponding to the pixel units 300 in the $1441^{st}$ row may be connected to the first light-emitting control line which is connected to EOA1.

It should be appreciated that, the features, structures or materials may be combined in any embodiment or embodiments in an appropriate manner.

The above embodiments are for illustrative purposes only, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A pixel driving circuit for driving a light-emitting unit, comprising:

a driving unit connected to the light-emitting unit;

a capacitor unit, one end of the capacitor unit is connected to the driving unit, and a second end of the capacitor unit is connected to a power source signal input end;

a data write-in unit connected to a corresponding gate line in a row direction, a corresponding data line in a column direction and the driving unit;

a power source control unit connected to a first light-emitting control end, the power source signal input end and the driving unit; and a first light-emitting control unit connected to a second light-emitting control end, the power source signal input end and the driving unit, and configured to, within a predetermined time period of a light-emitting stage, control the power source signal input end to be electrically connected to the driving unit under the control of the second light-emitting control end, stop the operation of the driving unit, and enable the light-emitting unit stop emitting light.

2. The pixel driving circuit according to claim 1, wherein the driving unit comprises a driving transistor, a first electrode of the driving transistor is connected to the light-emitting unit;

the first end of the capacitor unit is connected to a gate electrode of the driving transistor;

the data write-in unit is connected to the gate electrode of the driving transistor;

the power source control unit is connected to a second electrode of the driving transistor; and the first light-emitting control unit is connected to the gate electrode of the driving transistor, and further configured to, within the predetermined time period of the light-emitting stage, control the power source signal input end to be electrically connected to the gate electrode of the driving transistor under the control of the second light-emitting control end.

3. The pixel driving circuit according to claim 2, wherein the predetermined time period is a time period between a predetermined time point and an ending time point, the ending time point is a time point where the light-emitting stage is ended, and the predetermined time point is any time point between T/16+D and T/4+D, where D represents a start time point of the light-emitting stage, and T represents a frame of time for display.

4. The pixel driving circuit according to claim 2, wherein the data write-in unit comprises a first switching transistor, a gate electrode of which is connected to the corresponding gate line, a first electrode of which is connected to the gate electrode of the driving transistor, and a second electrode of which is connected to the corresponding data line;

the power source control unit comprises a second switching transistor, a gate electrode of which is connected to the first light-emitting control end, a first electrode of which is connected to the second electrode of the driving transistor, and a second electrode of which is connected to the power source signal input end; and the first light-emitting control unit comprises a third switching transistor, a gate electrode of which is connected to the second light-emitting control end, a first electrode of which is connected to the power source signal input end, and a second electrode of which is connected to the gate electrode of the driving transistor.

5. The pixel driving circuit according to claim 1, wherein the driving unit comprises a driving transistor, a first electrode of the driving transistor is connected to the light-emitting unit;

the first end of the capacitor unit is connected to a gate electrode of the driving unit;

the data write-in unit is connected to a second electrode of the driving transistor;

the power source control unit is connected to a second electrode of the driving transistor; and the first light-emitting control unit is connected to the gate electrode of the driving transistor, and further configured to, within the predetermined time period of the light-emitting stage, control the power source signal input end to be electrically connected to the gate electrode of the driving transistor under the control of the second light-emitting control end, wherein the pixel driving circuit further comprises:

a first resetting unit connected to a resetting control end, the gate electrode of the driving transistor and a reference signal input end respectively, and configured to control the gate electrode of the driving transistor to be electrically connected to, or electrically disconnected from, the reference signal input end under the control of the resetting control end; and a compensation unit connected to the corresponding gate line, the gate electrode of the driving transistor and the first electrode of the driving transistor respectively, and configured to control the gate electrode of the driving transistor to be electrically connected to, or electrically disconnected from, the first electrode of the driving transistor under the control of the corresponding gate line.

6. The pixel driving circuit according to claim 5, further comprising:

a second resetting unit connected to the corresponding gate line, the light-emitting unit and the reference signal input end, and configured to control the light-emitting unit to be electrically connected to, or electrically disconnected from, the reference signal input end under the control of the corresponding, gate line; and a second light-emitting control unit, a first electrode of the driving transistor being connected to the light-emitting unit via the second light-emitting control unit, the second light-emitting control unit being connected to the first light-emitting control end, the first electrode of the driving transistor and the light-emitting unit, and configured to control the first electrode of the driving transistor to be electrically connected to, or electrically disconnected from, the light-emitting unit under the control of the first light-emitting control end.

7. The pixel driving circuit according to claim 6, wherein the power source control unit comprises a second switching transistor, a gate electrode of which is connected to the first light-emitting control end, a first electrode of which is connected to the second electrode of the driving transistor, and a second electrode of which is connected to the power source signal input end;

the first light-emitting control unit comprises a third switching transistor, a gate electrode of which is connected to the second light-emitting control end, a first electrode of which is connected to the power source signal input end, and a second electrode of which is connected to the gate electrode of the driving transistor;

the first resetting unit comprises a fourth switching transistor, a gate electrode of which is connected to the resetting control end, a first electrode of which is connected to the gate electrode of the driving transistor, and a second electrode of which is connected to the reference signal input end;

the second resetting unit comprises a fifth switching transistor, a gate electrode of which is connected to the corresponding gate line, a first electrode of which is connected to the light-emitting unit, and a second electrode of which is connected to the reference signal input end;

the compensation unit comprises a sixth switching transistor, a gate electrode of which is connected to the corresponding gate line, a first electrode of which is connected to the gate electrode of the driving transistor, and a second electrode of which is connected to the first electrode of the driving transistor;

the second light-emitting control unit comprises a seventh switching transistor, a gate electrode of which is connected to the first light-emitting control end, a first electrode of which is connected to the light-emitting unit, and a second electrode of which is connected to the first electrode of the driving transistor; and the data write-in unit comprises an eighth switching transistor, a gate electrode of which is connected to the corresponding gate line, a first electrode of which is connected to the second electrode of the driving transistor, and a second electrode of which is connected to the corresponding data line.

8. The pixel driving circuit according to claim 5, wherein the predetermined time period is a time period between a predetermined time point and an ending time point, the ending time point is a time point where the light-emitting stage is ended, and the predetermined time point is any time point between T/16+D and T/4+D, where D represents a start time point of the light-emitting stage, and T represents a frame of time for display.

9. A method of driving the pixel driving circuit according to claim 1, comprising, within the predetermined time period of the light-emitting stage, controlling, by a first light-emitting control unit, a power source signal input end to be electrically connected to a driving unit under the control of a second light-emitting control end, stop the operation of the driving unit, and enable the light-emitting unit stop emitting light.

10. The method according to claim 9, wherein the driving unit comprises a driving transistor, a first electrode of the driving transistor is connected to the light-emitting unit;

the first end of the capacitor unit is connected to a gate electrode of the driving transistor;

the data write-in unit is connected to the gate electrode of the driving transistor;

the power source control unit is connected to a second electrode of the driving transistor; and the first light-emitting control unit is connected to the gate electrode of the driving transistor, and further configured to, within the predetermined time period of the light-emitting stage, control the power source signal input end to be electrically connected to the gate electrode of the driving transistor under the control of the second light-emitting control end.

11. The method according to claim 9, wherein the driving unit comprises a driving transistor, a first electrode of the driving transistor is connected to the light-emitting unit;

the first end of the capacitor unit is connected to a gate electrode of the driving unit;

the data write-in unit is connected to a second electrode of the driving transistor;

the power source control unit is connected to a second electrode of the driving transistor; and the first light-emitting control unit is connected to the gate electrode of the driving transistor, and further configured to, within the predetermined time period of the light-emitting stage, control the power source signal input end to be electrically connected to the gate electrode of the driving transistor under the control of the second light-emitting control end, wherein the pixel driving circuit further comprises:

a first resetting unit connected to a resetting, control end, the gate electrode of the driving transistor and a reference signal input end respectively, and configured to control the gate electrode of the driving transistor to be electrically connected to, or electrically disconnected from, the reference signal input end under the control of the resetting control end; and a compensation unit connected to the corresponding gate line, the gate electrode of the driving transistor and the first electrode of the driving transistor respectively, and configured to control the gate electrode of the driving transistor to be electrically connected to, or electrically disconnected from, the first electrode of the driving transistor under the control of the corresponding gate line.

12. The method according to claim 11, wherein the pixel driving circuit further comprises:

a second resetting unit connected to the corresponding gate line, the light-emitting unit and the reference signal input end, and configured to control the light-emitting unit to be electrically connected to, or electrically disconnected from, the reference signal input end under the control of the corresponding gate line; and a second light-emitting control unit, a first electrode of the driving transistor being connected to the light-emitting unit via the second light-emitting control unit, the second light-emitting control unit being connected to the first light-emitting control end, the first electrode of the driving transistor and the light-emitting unit, and configured to control the first electrode of the driving transistor to be electrically connected to, or electrically disconnected from, the light-emitting unit under the control of the first light-emitting control end.

13. A display device, comprising N pixel driving circuits according to claim 1, wherein N is a positive integer.

14. The display device according to claim 13, further comprising:

N pixel units arranged in a matrix form and in X rows, the pixel units corresponding to the pixel driving circuits respectively;

X gate lines corresponding to the X rows of pixel units respectively; and

X light-emitting control lines corresponding to the X rows of pixel units respectively, a first light-emitting control end being connected to a corresponding light-emitting control line, wherein a second light-emitting control end is connected to an $M^{th}$ gate line randomly selected from an $(X/16+C)^{th}$ gate line to an $(X/4+C)^{th}$ gate line, or connected to an $M^{th}$ light-emitting control line randomly selected from an $(X/16+C)^{th}$ light-emitting control line to an $(X/4+C)^{th}$ light-emitting control line, where C has a value acquired by subtracting 1 from the number of rows corresponding to the second light-emitting control end, wherein when M is greater than X, the second light-emitting control end is connected to an $(M-X)^{th}$ gate line or an $(M-X)^{th}$ light-emitting control line.

15. The display device according to claim 13, wherein the driving unit comprises a driving transistor, a first electrode of the driving transistor is connected to the light-emitting unit;

the first end of the capacitor unit is connected to a gate electrode of the driving transistor;

the data write-in unit is connected to the gate electrode of the driving transistor;

the power source control unit is connected to a second electrode of the driving transistor; and the first light-emitting, control unit is connected to the gate electrode of the driving transistor, and further configured to, within the predetermined time period of the light-emitting stage, control the power source signal input end to be electrically connected to the gate electrode of the driving transistor under the control of the second light-emitting control end.

16. The display device according to claim 15, wherein the predetermined time period is a time period between a predetermined time point and an ending time point, the ending time point is a time point where the light-emitting stage is ended, and the predetermined time point is any time point between T/16+D and T/4+D, where D represents a start time point of the light-emitting stage, and T represents a frame of time for display.

17. The display device according to claim 15, wherein the data write-in unit comprises a first switching transistor, a gate electrode of which is connected to the corresponding gate line, a first electrode of which is connected to the gate electrode of the driving transistor, and a second electrode of which is connected to the corresponding data line;

the power source control unit comprises a second switching transistor, a gate electrode of which is connected to the first light-emitting control end, a first electrode of which is connected to the second electrode of the driving transistor, and a second electrode of which is connected to the power source signal input end; and the first light-emitting control unit comprises a third switching transistor, a gate electrode of which is connected to the second light-emitting control end, a first electrode of which is connected to the power source signal input end, and a second electrode of which is connected to the gate electrode of the driving transistor.

18. The display device according to claim 13, wherein the driving unit comprises a driving transistor, a first electrode of the driving transistor is connected to the light-emitting unit;

the first end of the capacitor unit is connected to a gate electrode of the driving unit;

the data write-in unit is connected to a second electrode of the driving transistor;

the power source control unit is connected to a second electrode of the driving transistor; and the first light-emitting control unit is connected to the gate electrode of the driving transistor, and further configured to, within the predetermined time period of the light-emitting stage, control the power source signal input end to be electrically connected to the gate electrode of the driving transistor under the control of the second light-emitting control end, wherein the pixel driving circuit further comprises:

a first resetting unit connected to a resetting control end, the gate electrode of the driving transistor and a reference signal input end respectively, and configured to control the gate electrode of the driving transistor to be electrically connected to, or electrically disconnected from, the reference signal input end under the control of the resetting control end; and a compensation unit connected to the corresponding gate line, the gate electrode of the driving transistor and the first electrode of the driving transistor respectively, and configured to control the gate electrode of the driving transistor to be electrically connected to, or electrically disconnected from, the first electrode of the driving transistor under the control of the corresponding gate line.

19. The display device according to claim 18, further comprising:

a second resetting unit connected to the corresponding gate line, the light-emitting unit and the reference signal input end, and configured to control the light-emitting unit to be electrically connected to, or electrically disconnected from, the reference signal input end under the control of the corresponding gate line; and a second light-emitting control unit, a first electrode of the driving transistor being connected to the light-emitting unit via the second light-emitting control unit, the second light-emitting control unit being connected to the first light-emitting control end, the first electrode of the driving transistor and the light-emitting unit, and configured to control the first electrode of the driving transistor to be electrically connected to, or electrically disconnected from, the light-emitting unit under the control of the first light-emitting control end.

20. The display device according to claim 18, wherein the power source control unit comprises a second switching transistor, a gate electrode of which is connected to the first light-emitting control end, a first electrode of which is connected to the second electrode of the driving transistor, and a second electrode of which is connected to the power source signal input end;

the first light-emitting control unit comprises a third switching transistor, a gate electrode of which is connected to the second light-emitting control end, a first electrode of which is connected to the power source signal input end, and a second electrode of which is connected to the gate electrode of the driving transistor;

the first resetting unit comprises a fourth switching transistor, a gate electrode of which is connected to the resetting control end, a first electrode of which is connected to the gate electrode of the driving transistor, and a second electrode of which is connected to the reference signal input end;

the second resetting unit comprises a fifth switching transistor, a gate electrode of which is connected to the corresponding gate line, a first electrode of which is connected to the light-emitting unit, and a second electrode of which is connected to the reference signal input end;

the compensation unit comprises a sixth switching transistor, a gate electrode of which is connected to the corresponding gate line, a first electrode of which is connected to the gate electrode of the driving transistor, and a second electrode of which is connected to the first electrode of the driving transistor;

the second light-emitting control unit comprises a seventh switching transistor, a gate electrode of which is connected to the first light-emitting control end, a first electrode of which is connected to the light-emitting unit, and a second electrode of Which is connected to the first electrode of the driving transistor; and the data write-in unit comprises an eighth switching transistor, a gate electrode of which is connected to the corresponding gate line, a first electrode of which is connected to the second electrode of the driving transistor, and a second electrode of which is connected to the corresponding data line.

* * * * *